US008316766B2

(12) United States Patent
McLaughlin

(10) Patent No.: US 8,316,766 B2
(45) Date of Patent: Nov. 27, 2012

(54) MEDIA INVERSION SYSTEM FOR A CONTINUOUS WEB PRINTER

(75) Inventor: Matthew Ryan McLaughlin, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 659 days.

(21) Appl. No.: 12/560,483

(22) Filed: Sep. 16, 2009

(65) Prior Publication Data

US 2011/0064507 A1 Mar. 17, 2011

(51) Int. Cl.

| | |
|---|---|
| ***B41F 13/54*** | (2006.01) |
| ***B41F 13/56*** | (2006.01) |
| ***B65H 23/035*** | (2006.01) |
| ***B65H 23/32*** | (2006.01) |

(52) U.S. Cl. ..... 101/228; 101/227; 242/615.21

(58) Field of Classification Search ..... 101/223, 101/228, 222, 225, 227, 232; 400/611, 612; 226/15, 24, 27, 34; 242/615.12, 615.21
See application file for complete search history.

(56) References Cited

U.S. PATENT DOCUMENTS

| | | | | |
|---|---|---|---|---|
| 3,598,332 | A * | 8/1971 | Sharkey | 242/578 |
| 4,778,093 | A * | 10/1988 | Renold | 226/113 |
| 5,016,801 | A * | 5/1991 | Gilat et al. | 242/615.21 |
| 5,100,117 | A * | 3/1992 | Hajek et al. | 270/52.08 |
| 5,357,859 | A * | 10/1994 | Eckert | 101/228 |
| 5,568,245 | A | 10/1996 | Ferber et al. | |
| 5,970,304 | A | 10/1999 | Stemmle | |
| 6,050,191 | A * | 4/2000 | Enderle et al. | 101/222 |
| 6,487,388 | B2 | 11/2002 | Theodoulou et al. | |
| 6,666,399 | B2 | 12/2003 | Perdu | |
| 6,782,817 | B2 * | 8/2004 | Izawa et al. | 101/223 |
| 2006/0107855 | A1 | 5/2006 | Hatayama | |
| 2007/0172285 | A1 * | 7/2007 | Izawa et al. | 400/188 |

FOREIGN PATENT DOCUMENTS

| | | |
|---|---|---|
| DE | 19751417 | 6/1999 |
| EP | 1813432 A1 | 8/2007 |
| GB | 2171084 A | 8/1986 |

OTHER PUBLICATIONS

European Search Report corresponding to EP Application No. 10177062.6, European Patent Office, Rijswijk, Netherlands, Aug. 26, 2011 (8 pages).

* cited by examiner

*Primary Examiner* — Daniel J Colilla
*Assistant Examiner* — Marissa Ferguson Samreth
(74) *Attorney, Agent, or Firm* — Maginot, Moore & Beck, LLP

(57) ABSTRACT

A continuous web inversion system for use in a continuous web imaging device includes a first turn bar positioned to receive a substantially continuous web moving in a first direction with a first surface facing in a printing direction and to flip the web and direct it in a second direction perpendicular to the first direction. A second turn bar is positioned to receive the continuous web from the first turn bar to flip the web and direct it in a third direction opposite the first direction. A third turn bar is positioned to receive the continuous web from the second turn bar to flip the web and direct it in the first direction with a second surface of the web facing in the printing direction. The second and the third turn bars are coupled together and supported for translation along an axis perpendicular to the first direction. A sensor is configured to generate a signal indicative of a lateral position of the continuous web exiting the third turn bar. A driver is operably coupled to at least one of the second and the third turn bars to adjust a position of the third turn bar along the axis based on the signal.

11 Claims, 3 Drawing Sheets

MEDIA INVERSION SYSTEM FOR A CONTINUOUS WEB PRINTER

TECHNICAL FIELD

The present disclosure relates to ink-jet printing, particularly involving phase-change inks printing on a substantially continuous web.

BACKGROUND

In general, ink jet printing machines or printers include at least one printhead that ejects drops or jets of liquid ink onto a recording or image forming media. A phase change ink jet printer employs phase change inks that are in the solid phase at ambient temperature, but transition to a liquid phase at an elevated temperature. The molten ink can then be ejected onto a printing media by a printhead directly onto an image receiving substrate, or indirectly onto an intermediate imaging member before the image is transferred to an image receiving substrate. Once the ejected ink is on the image receiving substrate, the ink droplets quickly solidify to form an image.

In both the direct and offset printing architecture, images may be formed on a media sheet or a media web. In a web printer, a continuous supply of media, typically provided in a media roll, is mounted onto rollers that are driven by motors. A loose end of the media web is passed through a print zone opposite the print head or heads of the printer. Beyond the print zone, the media web is gripped and pulled by mechanical structures so a portion of the media web continuously moves through the print zone. Tension bars or rollers may be placed in the feed path of the moving web to remove slack from the web so it remains taut without breaking.

Some direct marking, continuous web printers are configured to print images onto both sides of the web, also referred to as duplex printing. To enable duplex printing on a continuous web, a web transport system may be configured to print onto one side of the web and direct the web back through an inversion system that inverts, or flips, the web over so that the opposite side is facing the print zone. To invert the web for duplex printing, some previously known systems utilized fixed turn bars that invert the web after printing one side (e.g., simplex side), and laterally offset the web to direct the web to the entrance of the duplex web path for printing on the other side (duplex side), all without active registration. Typical setups strive to maintain alignment of the web as it enters and exits the turn bars. Making the exit turn bar adjustable may effectively change the lateral registration of the web. However, adjusting the position of the exit turn bar alters the web path length which, as mentioned above, can affect web tension to cause loss of web control, web damage, or breakage. In other previously known systems, a bias roller with a manually adjusted edge guide has also been used to laterally register the return path web, but it is known to generate loose paper dust and fibers that may contaminate the printheads, thus reducing image quality and printhead life.

SUMMARY

The present disclosure proposes an inversion system that is capable of inverting a continuous web and automatically laterally registering the web for feeding onto the duplex side printing path of a direct marking, continuous web imaging device. In one embodiment, a continuous web inversion system for use in a direct marking comprises a first turn bar positioned to receive a substantially continuous web moving in a first direction in a first plane with a first surface of the continuous web facing in a printing direction and to direct the continuous web in a second direction perpendicular to the first direction in a second plane parallel to the first plane with a second surface of the continuous web facing in the printing direction. A second turn bar is positioned to receive the continuous web from the first turn bar and to direct the continuous web in a third direction opposite the second direction in a third plane parallel to the first plane with the first surface facing in the printing direction. A third turn bar is positioned to receive the continuous web from the second turn bar and to direct the continuous web in the first direction in a fourth plane parallel to the first plane with the second surface facing the printing direction. The second and the third turn bars are each supported for translation along an axis parallel to the second and third directions and connected to each other to maintain a predetermined distance between the second and third turn bars along the axis when translated. A sensor is configured to generate a signal indicative of a lateral position of the continuous web exiting the third turn bar. A driver is operably coupled to at least one of the second and the third turn bars and configured to adjust a position of the third turn bar along the axis based on the signal.

In another embodiment, a continuous web transport system for use in a direct marking is provided. The system comprises a source of a substantially continuous web having a first surface and a second surface opposite the first surface. The system also includes a web transport system having a first and a second web path each configured to transport different portions of the continuous web simultaneously side by side in a process direction from a first end to a second end of the web transport system with the different portions being coplanar and laterally spaced a predetermined distance from each other in a cross-process direction. The web transport system includes a return path for directing a web portion on the first web path from the second end to the first end and onto the second web path. The first web path receives the continuous web from the source with the first surface of the continuous web facing in a printing direction. An inversion system is positioned along the return path between the exit and the entrance. The inversion system includes a first turn bar positioned to receive a substantially continuous web moving in a first direction in a first plane with a first surface of the continuous web facing in a printing direction and to direct the continuous web in a second direction perpendicular to the first direction in a second plane parallel to the first plane with a second surface of the continuous web facing in the printing direction. A second turn bar is positioned to receive the continuous web from the first turn bar and to direct the continuous web in a third direction opposite the second direction in a third plane parallel to the first plane with the first surface facing in the printing direction. A third turn bar is positioned to receive the continuous web from the second turn bar and to direct the continuous web in the first direction in a fourth plane parallel to the first plane with the second surface facing the printing direction. The second and the third turn bars are each supported for translation along an axis parallel to the second and third directions and connected to each other to maintain a predetermined distance between the second and third turn bars along the axis when translated. A sensor is configured to generate a signal indicative of a lateral position of the continuous web exiting the third turn bar. A driver is operably coupled to at least one of the second and the third turn bars and configured to adjust a position of the third turn bar along the axis based on the signal.

In yet another embodiment, a direct marking, continuous web imaging device is provided. The imaging device includes a source of a substantially continuous web having a first surface and a second surface opposite the first surface. The imaging device also includes a web transport system having a first and a second web path each configured to transport different portions of the continuous web simultaneously side by side in a process direction from a first end to a second end of the web transport system with the different portions being coplanar and laterally spaced a predetermined distance from each other in a cross-process direction. The web transport system includes a return path for directing a web portion on the first web path from the second end to the first end and onto the second web path. The first web path receives the continuous web from the source with the first surface of the continuous web facing in a printing direction. A printing system is located along the first and the second web paths and configured to deposit marking material onto surfaces of the continuous web moving along the first and the second web paths that are facing the printing direction. An inversion system is positioned along the return path between the exit and the entrance. The inversion system includes a first turn bar positioned to receive a substantially continuous web moving in a first direction in a first plane with a first surface of the continuous web facing in a printing direction and to direct the continuous web in a second direction perpendicular to the first direction in a second plane parallel to the first plane with a second surface of the continuous web facing in the printing direction. A second turn bar is positioned to receive the continuous web from the first turn bar and to direct the continuous web in a third direction opposite the second direction in a third plane parallel to the first plane with the first surface facing in the printing direction. A third turn bar is positioned to receive the continuous web from the second turn bar and to direct the continuous web in the first direction in a fourth plane parallel to the first plane with the second surface facing the printing direction. The second and the third turn bars are each supported for translation along an axis parallel to the second and third directions and connected to each other to maintain a predetermined distance between the second and third turn bars along the axis when translated. A sensor is configured to generate a signal indicative of a lateral position of the continuous web exiting the third turn bar. A driver is operably coupled to at least one of the second and the third turn bars and configured to adjust a position of the third turn bar along the axis based on the signal.

DETAILED DESCRIPTION

Figure 1:
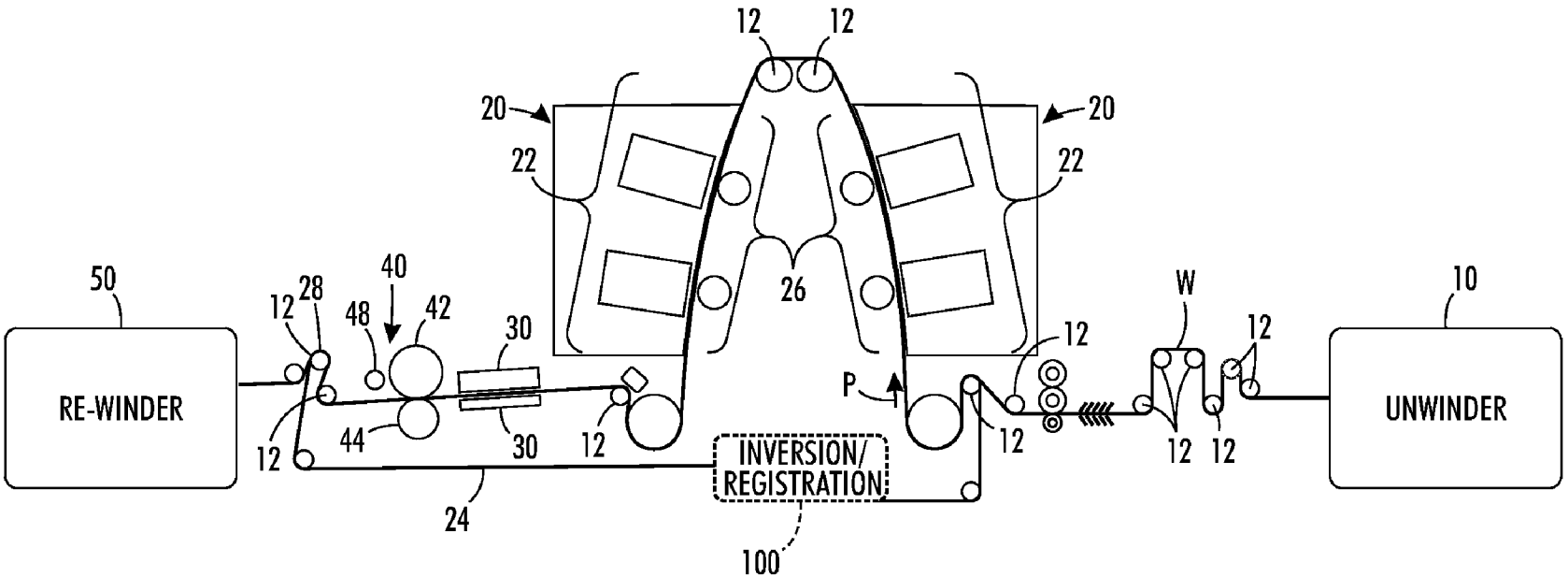
FIG. 1 is a simplified elevational view of a direct-to-web, continuous-web, phase-change ink printer.

For a general understanding of the present embodiments, reference is made to the drawings. In the drawings, like reference numerals have been used throughout to designate like elements.

As used herein, the term "imaging device" generally refers to a device for applying an image to print media. "Print media" can be a physical sheet of paper, plastic, or other suitable physical media or substrate for images, whether pre-cut or web fed. The imaging device may include a variety of other components, such as finishers, paper feeders, and the like, and may be embodied as a copier, printer, or a multi-function machine. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like.

FIG. 1 is a simplified elevational view of a continuous-web printer. A web supply and transport system is configured to supply a very long (i.e., substantially continuous) web W of "substrate" (paper, plastic, or other printable material) from an unwinder 10. The web W may be unwound as needed, and propelled by a variety of motors, not shown, along a web path. A set of rollers 12 controls the tension of the web as the web moves through the path.

Figure 2:
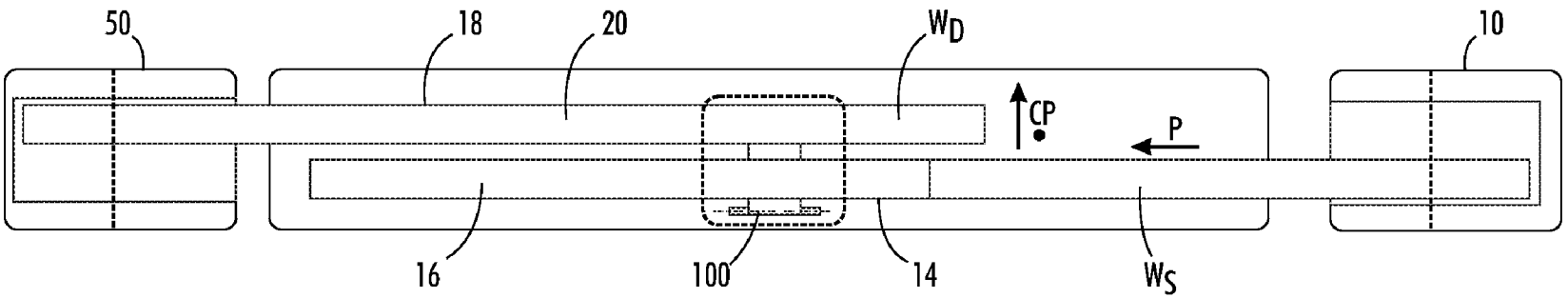
FIG. 2 is bottom view of the direct-to-web, continuous-web, phase-change ink printer of FIG. 1.

As explained below, the imaging device of FIG. 1 is a duplex printer meaning that it is capable of printing images onto both sides of the continuous web. In the embodiment of FIG. 1, to enable duplex printing, the web transport system (and printing system as explained below) is a dual width, or dual path, transport system that is configured to transport two lengths of the web, $W_S$ and $W_D$, along the web path simultaneously. Accordingly, in one embodiment, the rollers that transport and guide the web along the web path are at least twice the width of the web to accommodate the two lengths of the web. As depicted in FIGS. 1 and 2, a first side 14 of the web transport system is configured to transport a portion of the web $W_S$ with one of the surfaces, i.e., simplex surface 16, of the web facing in a direction to be printed upon by the printheads of the print station, also referred to herein as the printing direction. The second side 18 of the web transport system is configured to transport a portion of the web with the opposite surface, i.e., the duplex surface 20, of the web facing the printing direction. For the purposes of this disclosure, the first or simplex side 14 and the second or duplex side 18 of the web transport system may also be referred to as the first or simplex web path and the second or duplex web path, respectively. The dual web path of the web transport system includes entrance roller(s) 26 and an exit roller(s) 28.

The web transport system is configured to transport the web along the simplex 14 and duplex 18 web paths simultaneously and maintain consistent lateral positioning of the webs at least in the print zone so that images formed on the web are accurately registered. Any suitable method of registering or positioning of the webs along the dual path web transport system may be utilized. For example, edge sensors, as are known in the art, may be used to detect the edges of the webs, and suitable mechanisms for correcting or compensating for deviations of the web positions from desired positions may be used to adjust the lateral positions of the web at one or more positions along the dual web paths to ensure consistent and accurate positioning and/or spacing of the webs at least in the print zone.

As depicted in FIGS. 1 and 2, the simplex web 14 path of the dual path web transport system is configured to receive the continuous web from the unwinder 10 with the simplex surface 16 of the web facing in the printing direction. The duplex web path 18 of the web transport system is configured to receive the continuous web from a return path 24 that directs the continuous web moving on the simplex web path 14 from the exit 28 located after the printing system back to the entrance 12 of the duplex web path. As explained below, an inversion system 100 is positioned on the return path that is configured to invert the continuous web so that the surface opposite the simplex surface of the web (i.e., the duplex surface) is facing in the printing direction when it enters the duplex web path at the entrance to the web transport system.

In addition, the inversion system is configured to automatically laterally register the web so that it accurately enters the duplex web path.

Although not depicted in to FIG. 1, along the dual paths of the web transport system there may be provided a preheater 18, which brings the webs to an initial predetermined temperature. The preheater 18 can rely on contact, radiant, conductive, or convective heat to bring the web W to a target preheat temperature, which in one practical embodiment, is in a range of about 30° C. to about 70° C.

The simplex and duplex web paths guide the respective webs W through a printing station or system including a series of printheads 22, each printhead effectively extending across the dual width of the web paths. In the embodiment of FIG. 1, the imaging device is a direct marking device in which the printheads are configured to place marking material directly (i.e., without use of an intermediate or offset member) onto the surfaces of the webs that are facing in the printing direction, e.g., the simplex surface of the web moving along the simplex web path and/or the duplex surface of the web moving along the duplex web path. In alternative embodiments, however, the imaging device may be configured as an indirect marking imaging device as known in the art. As is generally familiar, each of the four primary-color images placed on overlapping areas on a web combine to form a full-color image, based on the image data sent to each printhead. In various possible embodiments, there may be provided multiple printheads 22 for each primary color; the printheads can each be formed into a single linear array; the function of each color printhead can be divided among multiple distinct printheads located at different locations along the process direction; or the printheads or portions thereof can be mounted movably in a direction CP transverse to the process direction P, such as for spot-color applications.

In one embodiment, the marking material comprises a "phase-change ink," by which is meant that the ink is substantially solid at room temperature and substantially liquid when initially jetted onto the web W. Currently, common phase change inks are typically heated to about 100° C. to 140° C. to melt the solid ink for jetting onto the web W. Generally speaking, the liquid ink cools down quickly upon hitting the web W. Alternatively, however, the marking material may be any suitable type of marking material, such as aqueous ink, wax-based ink, toner, UV curable ink, and the like.

Associated with each printhead 22 is a backing member 26, typically in the form of a bar or roll, which is arranged substantially opposite the printhead on the other side of web W. Each backing member is used to position the web W so that the gap between the printhead and the web stays at a known, constant distance. Each backing member can be controlled to cause the adjacent portion of the web to reach a predetermined "ink-receiving" temperature, in one practical embodiment, of about 40° C. to about 60° C. In various possible embodiments, each backing member can include heating elements, cavities for the flow of liquids therethrough, etc.; alternatively, the "member" can be in the form of a flow of air or other gas against or near a portion of the web W. The combined actions of the preheater plus backing members 26 held to a particular target temperature effectively maintains the web W in the printing zone in a predetermined temperature range of about 40° C. to 70° C.

Following the printing zone along the dual web path W is one or more "midheaters" 30. Midheaters 30 can use contact, radiant, conductive, and/or convective heat to bring the web W to the target temperature. The midheaters 30 bring the ink placed on the web to a temperature suitable for desired properties when the ink on the web is sent through the spreader 40. In one embodiment, a useful range for a target temperature for the midheater is about 35° C. to about 80° C. The midheaters 30 have the effect of equalizing the ink and substrate temperatures to within about 15° C. of each other. Lower ink temperature gives less line spread while higher ink temperature causes show-through (visibility of the image from the other side of the print). The midheaters 30 adjust substrate and ink temperatures to 0° C. to 20° C. above the temperature of the spreader, which will be described below.

Following the midheaters 30, along the dual path of web W, is a "spreader" 40, that applies a predetermined pressure, and in some implementations, heat, to the web W. The function of the spreader 40 is to take what are essentially isolated droplets of ink on web W and smear them out to make a continuous layer by pressure, and, in one embodiment, heat, so that spaces between adjacent drops are filled and image solids become uniform. In addition to spreading the ink, the spreader 40 may also improve image permanence by increasing ink layer cohesion and/or increasing the ink-web adhesion. The spreader 40 includes rolls, such as image-side roll 42 and pressure roll 44, that apply heat and pressure to the web W. Either roll can include heat elements to bring the web W to a temperature in a range from about 35° C. to about 80° C.

In one practical embodiment, the roll temperature in spreader 40 is maintained at about 55° C.; generally, a lower roll temperature gives less line spread while a higher temperature causes imperfections in the gloss. A roll temperature higher than about 57° C. causes ink to offset to the roll. In one practical embodiment, the nip pressure is set in a range of about 500 to about 2000 psi lbs/side. Lower nip pressure gives less line spread while higher may reduce pressure roll life.

The spreader 40 can also include a cleaning/oiling station 48 associated with image-side roll 42, suitable for cleaning and/or applying a layer of some lubricant or other material to the roll surface. Such a station coats the surface of the spreader roll with a lubricant such as amino silicone oil having viscosity of about 10-200 centipoises. Only small amounts of oil are required and the oil carry out by web W is only about 1-10 mg per A4 size page. In one possible embodiment, the midheater 30 and spreader 40 can be combined within a single unit, with their respective functions occurring relative to the same portion of web W simultaneously.

Following passage through the spreader 40, the web being moved along the simplex web path 14 is directed at exit 28 onto the return path 24 to the inversion system 100 where the web is inverted and laterally registered for entrance onto the duplex web path 18. Following the spreader, the duplex web path 18 directs the printed web to a winder 50 which winds the web. Alternatively, the web may be directed to any of a number of other suitable finishing devices, such as cutters for cutting the web into sheets, and binders for binding the cut sheets.

As mentioned, one difficulty faced in duplex printing on a continuous web printer that utilizes a dual web path, such as described above, is consistent and lateral (cross process direction) web registration. Any registration variation occurring to the simplex web results in a cumulative error for duplex side registration. For example, a challenge for imaging devices such as described above is that drive rolls form a nip (to generate web drive and tension) that constrains the duplex or mobius loop of web to a fixed length. Any lateral registration correction of the web while printing is likely to alter the desired web path through the return path and inversion system, thereby altering affecting the path length and web tension (that could cause slack or broken web).

Some previously known systems utilized fixed turn bars that invert the web after printing one side (e.g., simplex side), and laterally offset the web to direct the web to the entrance of the duplex web path for printing on the other side (duplex side), all without active registration. Typical setups strive to maintain alignment of the web as it enters and exits the turn bars. Making the exit turn bar adjustable may effectively change the lateral registration of the web. However, adjusting the position of the exit turn bar alters the web path length which, as mentioned above, can affect web tension to cause loss of web control, web damage, or breakage. In other previously known systems, a bias roller with a manually adjusted edge guide has also been used to laterally register the return path web, but it is known to generate loose paper dust and fibers that may contaminate the printheads, thus reducing image quality and printhead life.

As an alternative to using the above-described previously known inversion and registration systems or methods, the present disclosure proposes the use of an inversion/registration system that utilizes a series of turn bars that are oriented to properly invert and offset a continuous web, and makes use of a control system, sensor, motor, drives, and linear slides to provide position control of the exit turn bar (and web). A linkage and counterbalance with the upstream idler roll provides lateral position control to ensure consistent web path length and maintain web tension.

Figure 3:
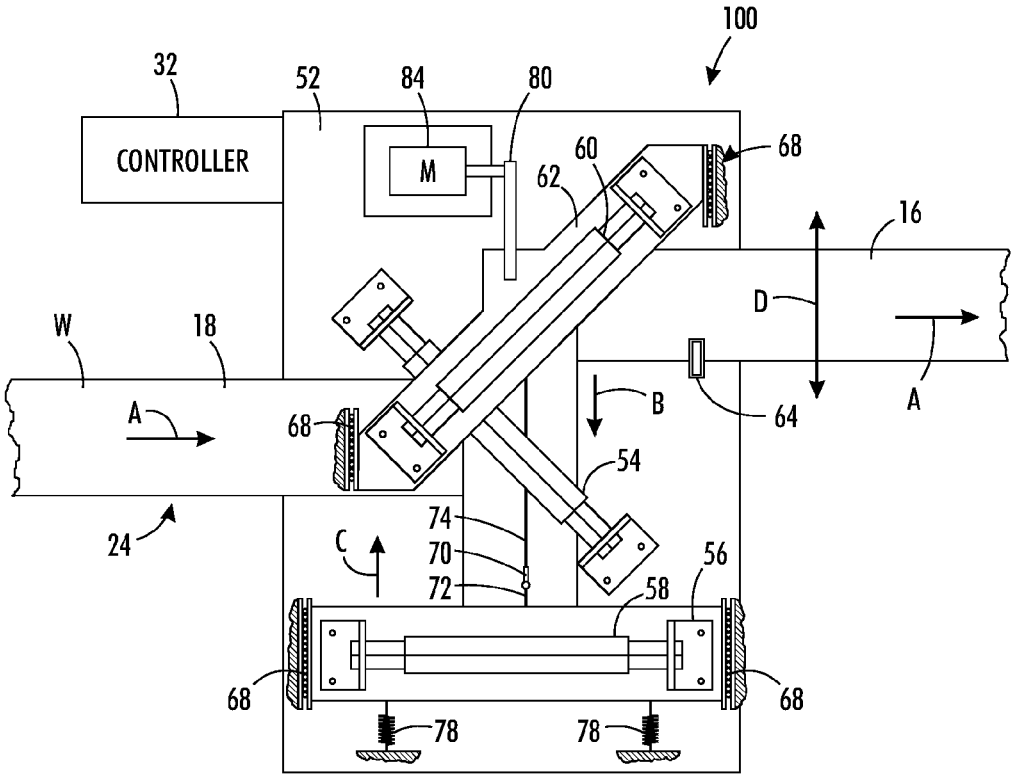
FIG. 3 is a plan view of an embodiment of an inversion system for use with the imaging device of FIG. 1.

FIG. 3 shows an embodiment of an inversion/registration system 100 that may be utilized in the imaging device of FIG. 1 to invert and register the web for duplex printing. As depicted in FIG. 3, the inversion/registration system 100 includes a first 90 degree turn bar (also referred to as entrance turn bar) 54, a second turn bar 58, and a third 90 degree turn bar (also referred to as exit turn bar) 60. The entrance turn bar 54 is positioned to receive the continuous web W moving along the return path 24 in a first direction A (generally back towards the entrance 26 of the web transport system shown in FIG. 1) with the simplex surface 18 of the web facing downward. The entrance turn bar 54 is angled at 45 degrees with respect to the incoming web to direct the web in a second direction B perpendicular to the first direction A and in a plane that is substantially parallel to the plane of the web at the coming into the entrance roller. The web is inverted at this point so that the simplex surface is facing upward. The second turn bar 58 is positioned to receive the continuous web W from the first turn bar 54 and to direct the continuous web in a third direction C opposite the second direction B and in a plane parallel to the plane of the web coming into the second turn bar. The exit turn bar 60 is positioned to receive the continuous web from the second turn bar 58 with the simplex surface of the web facing downward. The exit turn bar 60 is angled at 45 degrees with respect to the incoming web to direct the web in the first direction A toward the entrance 26 to the web transport system (FIG. 1). The simplex surface of the web is facing upward at this point so that when the web is fed onto the duplex web path, the duplex surface 20 is facing in the printing direction to be printed upon at the printing station.

In one embodiment, the entrance 54 and exit turn bars 60 comprise air cushion style turn bars as are known in the art in which air is directed through the bars and through a plurality of holes along the shaft in the axial direction. Alternatively, the entrance 54 and exit turn bars 60 may comprise idler rollers. In the embodiment of FIG. 3, the second turn bar 58 comprises an idler roller although any suitable type of turn bar may be used.

During operation, with drive and spreader nips retracted, the web is threaded through the printer web path, along the return path, and through the inversion/registration system 100. The web passes through the invention via turn bars 54, 58, 60, in that order. Once threaded, tension is applied to eliminate any slack, wrinkles, etc from the web. The web drives engage and draw tension as required by the control system and media attributes. For example, the imaging device of FIG. 1 may use velocity control via roll encoders (not shown) and tension trim via load cells (not shown) on strategic rollers to measure web tension.

The position of the exit turn bar 60 along the axis D controls the lateral position of the web as it is fed onto the duplex web path. To enable adjustment of the lateral position of the web exiting the exit turn bar 60, the exit turn bar 60 is supported for translation along the axis D. In the embodiment of FIG. 3, the entrance turn bar 54, second turn bar 58, and exit turn bar 60 are supported by a frame 52. To enable translation, the exit turn bar 60 is supported on a sub-frame 62 that is translatably supported by the frame 52 for movement along the D axis. Translation may be enabled in any suitable manner. For example, the sub-frame 62 of the exit turn bar 60 may be supported by the frame 52 by linear slides 68. Any suitable device or method, however, may be used to enable translation of the exit turn bar along the D axis.

Linear motion along the D axis may be imparted to the sub-frame 62 and exit turn bar 60 using a driver having a linear drive shaft 80 operably coupled to motor 84. Adjustments may be made to the position of the exit turn bar 60 using a sensor 64 that is configured to detect the lateral position of the web W as it exits the exit turn bar 60. Any suitable sensor may be utilized.

Sensor 64 generates output indicative of the web position that may be read or received by the controller 32. Controller 32 is operably coupled to the motor 84 of the driver and is configured to actuate the motor 84 to cause the linear drive shaft 80 to move based on the sensor 64 output. Movement of the drive shaft 80 imparts a linear motion to the exit turn bar 60 mounted to sub-frame 62 on linear slides 68.

To enable adjustment of the lateral position of the web (e.g., lateral registration of the web) without altering the overall length of the web loop in the imaging device (which may affect web tension to cause loss of web control, web damage, or breakage), the second turn bar 58 is supported for translation along the D axis along with exit turn bar 60. For example, second turn bar 58 may be supported on a sub-frame 56 that is translatably supported by the frame 52 for movement along the D axis. Translation may be enabled in any suitable manner such as by linear slides 68. In one embodiment, sub-frame 62 of exit turn bar 60 and sub-frame 56 of second turn bar 58 are coupled together using a cable 72 that extends from sub-frame 56 of second turn bar 58 toward sub-frame 62 of exit turn bar 60 having a pulley 70 at a distal end thereof. A linkage cable 74 is anchored to the exit turn bar sub-frame 62 at one end and is routed through the pulley 70 with 180 degrees of wrap. The other end of the cable 74 is then attached to a surface such as inversion system frame 52.

When the exit turn bar sub-frame 62 is moved by linear drive 80, the cable 74 transmits a force to the second turn bar sub-frame 56 via the pulley 70. The second turn bar sub-frame 56 may be biased away from the exit turn bar sub-frame 62 using, for example, counterbalance extension springs 78 to draw the cable tight. In this configuration, any lateral movement of the exit turn bar 60 in either direction B or C will result in exactly half the displacement of the second turn bar 58. The second turn bar 58 has a web wrap of 180 degrees resulting in an un-altered web path length. This novel aspect ensures that consistent web tension can be maintained during web registration and enables correction and/or compensation of any registration errors.

The inversion system 100 described above enables adjustments of the duplex web position real time. The system may require web registration adjustment for any number of reasons. In the case of a printing system, examples of reasons for registration adjustment include: web tracking errors (due to roll wear, static, environmental conditions, paper (substrate) weight changes), web roll effects (camber, curl, edge & thickness variations), or to hide missing jet visibility (as with direct marking inkjet printing) by moving web and image panel out from under bad jets (space permitting). The inversion system also has a small design envelope, allowing inversion and active registration of web for duplex printing or finishing with a minimal footprint. In addition, the system can also compensate for web tracking errors at downstream areas where critical registration is required. For example a printer could use paper edge sensors and/or simplex side image sensors in the imaging area to ascertain web and simplex side image position, as well as to ensure that the web is not skewed or tracking relative to it's position as it exits the invention. Controls, software, and system memory can be used to learn and store optimal registration position(s) based on media type or other parameter, thereby maximizing useable output and minimizing wasted output at press startup. Additional registration sensor(s) could be mounted upstream to learn web tracking and compensate as the web reaches the exit turn bar span. This could provide improved registration by removing errors prior to the exit sensor described above, and the ability to adjust lateral web position real-time for any reason.

It will be appreciated that various of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. A web inversion system for use in a continuous web imaging device, the system comprising:

a first turn bar positioned to be partially wrapped by a substantially continuous web moving in a first direction with a first surface of the continuous web facing in a printing direction and to direct the continuous web in a second direction perpendicular to the first direction with a second surface of the continuous web facing in the printing direction;

a second turn bar positioned to be partially wrapped by the continuous web directed from the first turn bar and to direct the continuous web in a third direction opposite the second direction with the first surface facing in the printing direction, the second turn bar being wrapped 180 degrees by the continuous web;

a third turn bar positioned to be partially wrapped by the continuous web directed from the second turn bar and to direct the continuous web in the first direction with the second surface facing the printing direction, each of the first, second, and third turn bars comprising an idler roller;

a frame supporting the first, second, and third turn bars, the frame including linear slides operably coupled to the second and the third turn bars to enable translation of the second and third turn bars along an axis parallel to the second and third directions, the second and third turn bars being connected to each other to maintain a predetermined distance between the second and third turn bars when translated along the axis;

a pulley operably coupled to the second turn bar;

a linkage cable wrapped around the pulley and having one end attached to the third turn bar and the other end attached to the frame; and a driver operably coupled to at least one of the second and the third turn bars and configured to translate the second and the third turn bars along the axis.

2. The system of claim 1 further comprising:

biasing springs operably between the frame and the second turn bar for biasing the second turn bar in the second direction.

3. The system of claim 2, the driver further comprising:

a drive shaft operably coupled to the third turn bar;

a motor operably coupled to the drive shaft for linearly driving the drive shaft along the axis; and a controller operably coupled to the motor and the sensor and configured to actuate the motor based on the signal from the sensor.

4. A continuous web transport system for use in a continuous web imaging device comprising:

a source of a substantially continuous web having a first surface and a second surface opposite the first surface;

a web transport system having a first and a second web path each configured to transport different portions of the continuous web simultaneously side by side in a process direction from a first end to a second end of the web transport system with the different portions being coplanar and laterally spaced a predetermined distance from each other in a cross-process direction, the web transport system including a return path for directing a web portion on the first web path from the second end to the first end and onto the second web path, the first web path receiving the continuous web from the source with the first surface of the continuous web facing in a printing direction;

an inversion system positioned along the return path between the exit and the entrance, the inversion system including:

a first turn bar positioned to receive the continuous web moving in a first direction toward the first end in a first plane with the first surface facing in the printing direction and to direct the continuous web in a second direction perpendicular to the first direction in a second plane parallel to the first plane with the second surface facing in the printing direction;

a second turn bar positioned to receive the continuous web from the first turn bar and to direct the continuous web in a third direction opposite the second direction in a third plane parallel to the first plane with the first surface facing in the printing direction, the second turn bar being wrapped 180 degrees by the continuous web;

a third turn bar positioned to receive the continuous web from the second turn bar and to direct the continuous web in the first direction in a fourth plane parallel to the first plane with the second surface facing the printing direction, each of the first, second, and third turn bars comprising an idler roller;

a frame supporting the first, second, and third turn bars, the frame including linear slides operably coupled to the second and the third turn bars to enable translation of the second and third turn bars along an axis parallel to the second and third directions, the second and third turn bars being connected to each other to maintain a predetermined distance between the second and third turn bars along the axis when translated;

a pulley operably coupled to the second turn bar;

a linkage cable wrapped around the pulley and having one end attached to the third turn bar and the other end attached to the frame;

a sensor configured to generate a signal indicative of a lateral position of the continuous web exiting the third turn bar; and a driver operably coupled to at least one of the second and the third turn bars and configured to adjust a position of the third turn bar along the axis based on the signal.

5. The system of claim 4 further comprising:

biasing springs operably between the frame and the second turn bar for biasing the second turn bar in the second direction.

6. The system of claim 5, the driver further comprising:

a drive shaft operably coupled to the third turn bar;

a motor operably coupled to the drive shaft for linearly driving the drive shaft along the axis; and a controller operably coupled to the motor and the sensor and configured to actuate the motor based on the signal from the sensor.

7. A continuous web imaging device comprising:

a source of a substantially continuous web having a first surface and a second surface opposite the first surface;

a web transport system having a first and a second web path each configured to transport different portions of the continuous web simultaneously side by side in a process direction from a first end to a second end of the web transport system with the different portions being coplanar and laterally spaced a predetermined distance from each other in a cross-process direction, the web transport system including a return path for directing a web portion on the first web path from the second end to the first end and onto the second web path, the first web path receiving the continuous web from the source with the first surface of the continuous web facing in a printing direction;

a printing system located along the first and the second web paths and configured to deposit marking material onto surfaces of the continuous web moving along the first and the second web paths that are facing the printing direction;

an inversion system positioned along the return path between the exit and the entrance, the inversion system including:

a first turn bar positioned to receive the continuous web moving in a first direction toward the first end in a first plane with the first surface facing in the printing direction and to direct the continuous web in a second direction perpendicular to the first direction in a second plane parallel to the first plane with the second surface facing in the printing direction;

a second turn bar positioned to receive the continuous web from the first turn bar and to direct the continuous web in a third direction opposite the second direction in a third plane parallel to the first plane with the first surface facing in the printing direction;

a third turn bar positioned to receive the continuous web from the second turn bar and to direct the continuous web in the first direction in a fourth plane parallel to the first plane with the second surface facing the printing direction, the second web path being configured to receive the continuous web from the third turn bar with the second surface facing the printing direction, each of the first, second, and third turn bars comprising an idler roller;

a frame supporting the first, second, and third turn bars, the frame including linear slides operably coupled to the second and the third turn bars to enable translation of the second and third turn bars along an axis parallel to the second and third directions, the second and third turn bars being connected to each other to maintain a predetermined distance between the second and third turn bars along the axis when translated;

a pulley operably coupled to the second turn bar;

a linkage cable wrapped around the pulley and having one end attached to the third turn bar and the other end attached to the frame;

a sensor configured to generate a signal indicative of a lateral position of the continuous web exiting the third turn bar; and a driver operably coupled to at least one of the second and the third turn bars and configured to adjust a position of the third turn bar along the axis based on the signal.

8. The imaging device of claim 7, the marking material comprising melted phase change ink.

9. The imaging device of claim 8, further comprising:

a spreader positioned along the first and the second web paths downstream from the printing system and prior to the second end.

10. The imaging device of claim 9, further comprising:

a winder positioned downstream from the second end and configured to wind the continuous web received from the second web path.

11. The imaging device of claim 7, the second turn bar being wrapped 180 degrees by the continuous web.

* * * * *